US010196578B2

(12) United States Patent
Marcella et al.

(10) Patent No.: US 10,196,578 B2
(45) Date of Patent: Feb. 5, 2019

(54) MOTORCYCLE ENGINE LUBRICANT

(71) Applicant: The Lubrizol Corporation, Wickliffe, OH (US)

(72) Inventors: Michael J. Marcella, Madison, OH (US); Alexander Michlberger, Wickliffe, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 21 days.

(21) Appl. No.: 15/316,308

(22) PCT Filed: Jun. 16, 2015

(86) PCT No.: PCT/US2015/035952

§ 371 (c)(1),
(2) Date: Dec. 6, 2016

(87) PCT Pub. No.: WO2015/195614

PCT Pub. Date: Dec. 23, 2015

(65) Prior Publication Data

US 2017/0204347 A1 Jul. 20, 2017

Related U.S. Application Data

(60) Provisional application No. 62/013,602, filed on Jun. 18, 2014.

(51) Int. Cl.

| | |
|---|---|
| ***C10M 135/00*** | (2006.01) |
| ***C10M 135/18*** | (2006.01) |
| ***C10M 141/08*** | (2006.01) |
| ***C10M 141/10*** | (2006.01) |
| ***C10M 141/12*** | (2006.01) |
| ***C10M 133/06*** | (2006.01) |
| ***C10M 135/10*** | (2006.01) |
| ***C10M 139/00*** | (2006.01) |
| ***F02B 75/02*** | (2006.01) |

(52) U.S. Cl.

CPC ..... *C10M 135/18* (2013.01); *C10M 133/06* (2013.01); *C10M 135/10* (2013.01); *C10M 139/00* (2013.01); *C10M 141/08* (2013.01); *C10M 141/10* (2013.01); *C10M 141/12* (2013.01); *F02B 75/02* (2013.01); *C10M 2203/024* (2013.01); *C10M 2207/021* (2013.01); *C10M 2207/026* (2013.01); *C10M 2207/042* (2013.01); *C10M 2207/125* (2013.01); *C10M 2207/128* (2013.01); *C10M 2207/281* (2013.01); *C10M 2207/282* (2013.01); *C10M 2207/2805* (2013.01); *C10M 2207/289* (2013.01); *C10M 2207/2835* (2013.01); *C10M 2209/084* (2013.01); *C10M 2215/02* (2013.01); *C10M 2215/04* (2013.01); *C10M 2215/042* (2013.01); *C10M 2215/064* (2013.01); *C10M 2215/08* (2013.01); *C10M 2215/086* (2013.01); *C10M 2215/223* (2013.01); *C10M 2215/224* (2013.01); *C10M 2215/28* (2013.01); *C10M 2215/30* (2013.01); *C10M 2219/022* (2013.01); *C10M 2219/044* (2013.01); *C10M 2219/046* (2013.01); *C10M 2219/068* (2013.01); *C10M 2223/043* (2013.01); *C10M 2223/045* (2013.01); *C10M 2227/00* (2013.01); *C10M 2227/066* (2013.01); *C10N 2210/02* (2013.01); *C10N 2210/04* (2013.01); *C10N 2210/05* (2013.01); *C10N 2220/022* (2013.01); *C10N 2230/02* (2013.01); *C10N 2230/04* (2013.01); *C10N 2230/06* (2013.01); *C10N 2230/10* (2013.01); *C10N 2230/40* (2013.01); *C10N 2230/42* (2013.01); *C10N 2230/43* (2013.01); *C10N 2230/54* (2013.01); *C10N 2240/104* (2013.01); *C10N 2260/14* (2013.01); *F02B 2075/027* (2013.01)

(58) Field of Classification Search

CPC ..... C10M 135/18; C10M 141/12; C10M 139/00; C10M 135/10; C10M 133/06; C10M 141/08; C10M 2207/021; C10M 2207/042; C10M 2207/125; C10M 2207/128; C10M 2207/2805; C10M 2207/281; C10M 2215/02; C10M 2215/04; C10M 2215/042; C10M 2215/08; C10M 2215/086; C10M 2215/223; C10M 2215/224; C10M 2215/28; C10M 2219/022; C10M 2219/044; C10M 2219/068; C10M 2223/043; C10M 2223/045; C10M 2227/066; C10M 2215/30; C10M 2219/046; C10M 2227/00; C10M 2203/024; C10N 2230/02; C10N 2230/04; C10N 2230/06; C10N 2230/10; C10N 2230/54; C10N 2240/104; F02B 2075/027; F02B 75/02

See application file for complete search history.

(56) References Cited

U.S. PATENT DOCUMENTS

| | | | | |
|---|---|---|---|---|
| 4,203,854 | A | 5/1980 | Silverstein | |
| 5,439,605 | A | 8/1995 | Khorramian | |
| 2004/0018946 | A1* | 1/2004 | Aoyagi | C10M 129/24 508/390 |
| 2008/0096776 | A1* | 4/2008 | Carrick | C10M 141/12 508/192 |
| 2008/0096778 | A1 | 4/2008 | Breon et al. | |

(Continued)

FOREIGN PATENT DOCUMENTS

| | | | |
|---|---|---|---|
| EP | 2438148 | A1 | 4/2012 |
| WO | 2006068868 | A1 | 6/2006 |

*Primary Examiner* — Cephia D Toomer

(74) *Attorney, Agent, or Firm* — Michael Miller; David Shold

(57) ABSTRACT

The present invention relates to lubricant compositions for motorcycle engines where the crankcase lubricant is also used to lubricate a wet clutch. The lubricant compositions contain antimony dithiocarbamates in combination with one or more ash-free friction modifiers.

12 Claims, No Drawings

(56) References Cited

U.S. PATENT DOCUMENTS

| | | | | |
|---|---|---|---|---|
| 2008/0269090 | A1* | 10/2008 | Cook | C10M 159/20<br>508/391 |
| 2008/0280795 | A1 | 11/2008 | Fujitsu et al. | |
| 2011/0297122 | A1* | 12/2011 | Bardasz | C10M 133/56<br>123/299 |

* cited by examiner

MOTORCYCLE ENGINE LUBRICANT

BACKGROUND OF THE INVENTION

The present invention relates to lubricant compositions for motorcycle engines where the crankcase lubricant is also used to lubricate a wet clutch.

Lubricants for motorcycles typically provide lubrication for the engine (a crankcase) and a wet clutch. These two devices, although often lubricated by the same fluid, often have different lubrication requirements. For example, the lubrication of the engine desirably provides low metal-on-metal friction, to promote good fuel economy. (Typically, the "metal" referred to is steel.) However, the friction coefficient for the metal-on-composition interfaces located within the wet clutch is typically desired to be relatively high, to assure good engagement and power transmission. Additionally, motorcycle lubricants will also lubricate other devices such as gears or bearings, each having their own lubricating requirement. Many lubricants have been designed over the year for lubrication of motorcycles (also known as motorbikes or motorscooters). One such lubricant is described in U.S. Patent Publication 2008-0096778, Breon et al., Apr. 24, 2008.

Because of the varied and demanding lubrication performance required of them, motorcycle lubricants are typically designed specifically for use in motorcycles. That is, typical lubricants as used in lubricating passenger car engines are not normally used for motorcycles. Such lubricants may exhibit a low coefficient of friction that is undesirable for lubricating the wet clutch found in most motorcycles. The two types of lubricant technologies have, simply put, diverged in recent years.

Various friction-reducing additives are known. Glycerol monooleate ("GMO") is a well-known friction modifier for engines as disclosed in, e.g., U.S. Patent Publication 2008-0280795, Fujitsu, Nov. 13, 2008. However, GMO does not appear to be particularly effective in the present application. Various molybdenum compounds are also known as friction modifiers, as disclosed in, the aforementioned US 2008-0280795. However, Molybdenum dithiocarbamate compounds, while particularly effective at reducing dynamic friction in an internal combustion engine can present challenges when used in motorcycle wet clutch applications.

The disclosed technology, therefore, solves the problem of providing improved fuel economy and antioxidancy while maintaining clutch control in motorcycles equipped with a wet clutch. This is accomplished by supplying to both the crankcase and the clutch a lubricating composition comprising an oil of lubricating viscosity, an antimony dithiocarbamate compound, and an ash-free friction modifier. The disclosed technology may also be used to optimize power and acceleration while reducing oil sump temperatures.

SUMMARY OF THE INVENTION

The disclosed technology provides a method of operating a 4-stroke motorcycle engine equipped with a wet clutch, wherein the crankcase and wet clutch are lubricated with the same lubricant composition, said method comprising supplying to the engine and clutch a lubricant composition comprising (a) an oil of lubricating viscosity, (b) an antimony dialkyldithiocarbamate compound, and (c) an ash-free friction modifier comprising at least one of long chain fatty acid derivatives of amines, long chain fatty esters, derivatives of long chain fatty epoxides, fatty imidazolines; amine salts of alkylphosphoric acids, or fatty esters, amides or imides of hydroxy-carboxylic acids, wherein the lubricating composition comprises less than 50 weight percent of a synthetic ester having a kinematic viscosity of 5.5 to 25 $mm^2/s$ when measured at 100° C.

The disclosed technology further provides a method for improving the fuel economy and clutch performance of a motorcycle comprising supplying to said engine and clutch the foregoing lubricant. The invention further provides a method for improving the oxidation resistance of the lubricating composition while maintaining power and acceleration.

The invention further provides a method for lubricating high performance racing motorcycles while providing the aforementioned benefits, including reduced oil sump temperatures.

The invention further provides for a motorcycle lubricant composition comprising (a) an oil of lubricating viscosity, (b) an antimony dialkyldithiocarbamate compound, (c) an ash-free friction modifier comprising at least one of long chain fatty acid derivatives of amines, long chain fatty esters, derivatives of long chain fatty epoxides, fatty imidazolines; amine salts of alkylphosphoric acids, or fatty esters, amides or imides of hydroxy-carboxylic acids, (d) a nitrogen-containing molybdenum compound other than a dithiocarbamate complex, (e) 0.1 to 3 weight percent of a boron-containing dispersant, and (f) 0.1 to 3 weight percent of an alkylbenzenesulfonic acid detergent (that is, an alkylbenzene sulfonate detergent), wherein the alkyl groups comprise at least 50 weight percent branched hydrocarbyl groups, wherein the lubricating composition comprises less than 50 weight percent of a synthetic ester having a kinematic viscosity of 5.5 to 25 $mm^2/s$ when measured at 100° C.

DETAILED DESCRIPTION OF THE INVENTION

Various features and embodiments will be described below by way of non-limiting illustration.

The present invention provides a method of lubricating a 4-Stroke motorcycle engine equipped with a wet clutch, comprising supplying to said engine and clutch a lubricating composition comprising (a) an oil of lubricating viscosity, (b) an antimony dialkyldithiocarbamate compound, and (c) an ash-free friction modifier, wherein the lubricating composition comprises less than 50 weight percent of a synthetic ester having a kinematic viscosity of 5.5 to 25 $mm^2/s$ when measured at 100° C. Excessive amounts of such synthetic ester base fluids may be harmful for durability of elastomeric seals, as measured by ASTM D7216A2. The limits recited herein for the amounts of synthetic ester refer to the total amount of the described synthetic esters, if more than one such is present.

Antimony Dialkyldithiocarbamate

In the present technology, the lubricating composition comprises an oil of lubricating viscosity and an antimony dialkyldithiocarbamate compound.

The thiocarbamates used in making the thiocarbamate-containing compound are prepared by a well-known process, e.g. by reacting an amine with carbon disulfide or carbonyl sulfide, according to the reaction:

$$R^1R^2NH+CXS \rightarrow R^1R^2N—C(=X)SH$$

where X may be O or S and where $R^1$ and $R^2$ are independently hydrocarbyl groups containing 4 to 32 carbon atoms, or 8 to 24 carbon atoms, or 10 to 18 carbon atoms.

When the reaction is with $CS_2$, the product is a dithiocarbamic acid with X═S, as shown. When the reaction is with COS, the product is thiocarbamic acid, which can have the formula:

$$R^1R^2N—C(═O)SH$$

where $R^1$ and $R^2$ are as above.

As used herein, the terms "thiocarbamic" or "thiocarbamate" are intended to include dithiocarbamic or dithiocarbamate, unless otherwise specified. The thiocarbamic acid is generally not isolated, but is further reacted to form the thiocarbamate of the present invention. The thiocarbamic acid can be reacted with an antimony source to yield an antimony thiocarbamate.

Antimony dithiocarbamates can be prepared by reacting carbon disulfide with a secondary amine to form an intermediate ammonium dithiocarbamate which is then reacted with a suitable antimony reagent (such as antimony oxide $Sb_2O_3$) to form the desired dithiocarbamate compound.

The antimony dithiocarbamates may be represented by the formula

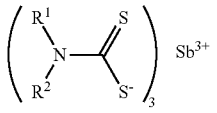

where $R^1$ and $R^2$ are independently hydrocarbyl groups containing 4 to 32 carbon atoms, or 8 to 24 carbon atoms, or 10 to 18 carbon atoms Hydrocarbyl groups represented by $R^1$ and $R^2$ include, but are not limited to alkyl groups, alkenyl groups, aryl groups, cycloalkyl groups, cycloalkenyl groups and mixtures thereof. Representative alkyl groups include n-butyl, isobutyl, sec-butyl, n-pentyl, amyl, neopentyl, n-hexyl, n-heptyl, secondary heptyl, n-octyl, secondary octyl, 2-ethyl hexyl, n-nonyl, secondary nonyl, undecyl, secondary undecyl, dodecyl, secondary dodecyl, tridecyl, secondary tridecyl, tetradecyl, secondary tetradecyl, hexadecyl, secondary hexadecyl, stearyl, icosyl, docosyl, tetracosyl, 2-butyloctyl, 2-butyldecyl, 2-hexyloctyl, 2-hexydecyl, 2-octyldecyl, 2-hexydodecyl, 2-octyldodecyl, 2-decyltetradecyl, 2-dodecylhexadecyl, 2-hexyldecyloctyldecyl, 2-tetradecyloctyldecy, monomethyl branched-isostearyl, etc. Antimony dithiocarbamates of the invention are well known in the art and are available commercially. Examples include the oil-soluble antimony dithiocarbamates having 4 to 32 carbon atoms such as the oil-soluble antimony dialkyldithiocarbamates having 8 to 24, such as 10 to 18, carbon atoms in the alkyl group.

Representative aryl groups include phenyl, toluyl, xylyl, cumenyl, mesityl, benzyl, phenethyl, styryl, cinnamyl, benzahydryl, trityl, ethylphenyl, propylphenyl, butylphenyl, pentylphenyl, hexylphenyl, heptaphenyl, octylphenyl, nonylphenyl, decylphenyl, undecylphenyl, dodecylphenyl benzylphenyl, styrenated phenyl, p-cumylphenyl, α-naphthyl, β-naphthyl groups and mixtures thereof.

In certain embodiments, the antimony dithiocarbamate compound may be present in a lubricating composition in an amount 0.025 to 2.5 weight percent, or alternatively 0.05 to 1.5 weight percent or 0.075 to 1.0 weight percent or 0.1 to 0.5 weight percent on an oil-free basis.

Ash-free Friction Modifier

The lubricant composition will also include at least one ash-free friction modifier. The friction modifier is a non-metal containing additive. A non-metal containing additive may also be referred to as an ashless (or ash-free) additive, since it will typically not produce any sulfated ash when subjected to the conditions of ASTM D 874. An additive is referred to as "non-metal containing" if it does not contribute metal content to the lubricant composition.

In certain embodiments, the friction modifier may be chosen from long chain fatty acid derivatives of amines, long chain fatty esters, or derivatives of long chain fatty epoxides; fatty imidazolines; amine salts of alkylphosphoric acids; and fatty esters, amides and/or imides of various hydroxy-carboxylic acids, such as tartaric acid, citric acid, malic acid, lactic acid, glycolic acid, and mandelic acid.

As used herein the term "fatty alkyl" or "fatty" in relation to friction modifiers means a carbon chain having 8 to 30 carbon atoms, typically a straight carbon chain.

In one embodiment ash-free friction modifier may be represented by the formula

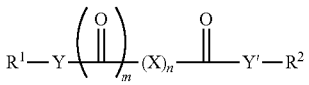

where, Y and Y' are independently —O—, >NH, >$NR^3$, or an imide group formed by taking together both Y and Y' groups and forming a $R^1$—N< group between two >C═O groups; X is independently —Z—O—Z'—, >$CH_2$, >$CHR^4$, >$CR^4R^5$, >C(OH)($CO_2R^2$), >C($CO_2R^2$)$_2$, or >$CHOR^6$; Z and Z' are independently >$CH_2$, >$CHR^4$, >$CR^4R^5$, >C(OH)($CO_2R^2$), or >$CHOR^6$; n is 0 to 10, with the proviso that when n=1, X is not >$CH_2$, and when n=2, both X's are not >$CH_2$; m is 0 or 1; $R^1$ is independently hydrogen or a hydrocarbyl group, typically containing 1 to 150 carbon atoms, with the proviso that when $R^1$ is hydrogen, m is 0, and n is more than or equal to 1; $R^2$ is a hydrocarbyl group, typically containing 1 to 150 carbon atoms; $R^3$, $R^4$ and $R^5$ are independently hydrocarbyl groups; and $R^6$ is hydrogen or a hydrocarbyl group, typically containing 1 to 150 carbon atoms, or 4 to 32 carbon atoms, or 8 to 24 carbon atoms. In certain embodiments, the hydrocarbyl groups $R^1$, $R^2$ and $R^3$ may be linear or predominantly linear alkyl groups.

In certain embodiments, the ash-free friction modifier is a fatty ester, amide, or imide of tartaric acid or malic acid. Examples of suitable materials include tartaric acid di(2-ethylhexyl) ester (i.e. di(2-ethylhexyl)tartrate), di(C8-C10) tartrate, di(C12-15)tartrate, di-oleyltartrate, oleyltarrimide, and oleyl malimide (where C8-C10 refers to $C_8$ alkyl to $C_{10}$ alkyl, and similarly with C12-15).

Examples of suitable friction modifiers include long chain fatty acid derivatives of amines, fatty esters, or fatty epoxides; fatty imidazolines such as condensation products of carboxylic acids and polyalkylene-polyamines; amine salts of alkylphosphoric acids; fatty alkyl tartrates; fatty alkyl tartrimides; fatty alkyl tartramides; fatty phosphonates; fatty phosphites; borated phospholipids, borated fatty epoxides; glycerol esters; borated glycerol esters; fatty amines; alkoxylated fatty amines; borated alkoxylated fatty amines; hydroxyl and polyhydroxy fatty amines including tertiary hydroxy fatty amines; hydroxy alkyl amides; metal salts of fatty acids; metal salts of alkyl salicylates; fatty oxazolines; fatty ethoxylated alcohols; condensation products of carboxylic acids and polyalkylene polyamines; or reaction products from fatty carboxylic acids with guanidine, aminoguanidine, urea, or thiourea and salts thereof.

Friction modifiers may also encompass materials such as sulfurized fatty compounds and olefins, sunflower oil or soybean oil monoester of a polyol and an aliphatic carboxylic acid.

In another embodiment the friction modifier may be a long chain fatty acid ester. In another embodiment the long chain fatty acid ester may be a mono-ester and in another embodiment the long chain fatty acid ester may be a triglyceride.

The amount of the ash-free friction modifier in a lubricant may be 0.1 to 3 percent by weight (or 0.05 to 4, 0.12 to 1.2, or 0.15 to 0.8 percent by weight). The material may also be present in a concentrate, alone or with other additives and with a lesser amount of oil. In a concentrate, the amount of material may be two to ten times the above concentration amounts.

Nitrogen-containing Molybdenum Compound

The lubricant composition may also include at least one nitrogen-containing molybdenum compound, which may be beneficial for, among other things, antioxidancy. The molybdenum compound will be other than a dithiocarbamate complex of molybdenum. That is, the specified molybdenum compound will not contain dithiocarbamate moieties or ligands. Molybdenum dithiocarbamate moieties may result in undesirable friction properties, so if an additional molybdenum compound is present that does contain a dithiocarbamate moiety, its amount may desirably be less than 0.1 percent by weight of the lubricant composition, or less than 0.03 or 0.01 percent, or 0.0001 to 0.005 percent by weight.

Nitrogen-containing molybdenum materials include molybdenum-amine compounds as described in U.S. Pat. No. 6,329,327; and organomolybdenum compounds made from the reaction of a molybdenum source, fatty oil, and a diamine as described in U.S. Pat. No. 6,914,037.

Molybdenum amine compounds may be obtained by reacting a compound containing a hexavalent molybdenum atom with a primary, secondary or tertiary amine represented by the formula $NR^1R^2R^3$, where each of $R^1$, $R^2$ and $R^3$ are independently hydrogen or a hydrocarbyl group of 1 to 32 carbon atoms and wherein at least one of $R^1$, $R^2$ and $R^3$ is a hydrocarbyl group of 4 or more carbon atoms or represented by the formula

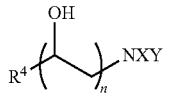

where $R^4$ represents a hydrocarbyl group having 10 or more carbon atoms, n is 0 or 1, X and/or Y represents a hydrogen atom, a hydrocarbyl group, an alkanol group or an alkyl amino group having 2 to 4 carbon atoms, and when n=0, X and Y are not both hydrogen atoms and X and Y are not both hydrocarbon groups.

Specific examples of suitable amines include monoalkyl (or alkenyl) amines such as tetradecylamine, stearylamine, oleylamine, beef tallow alkylamine, hardened beef tallow alkylamine, and soybean oil alkylamine; dialkyl(or alkenyl) amines such as N-tetradecylmethylamine, N-p entadecylmethyl amine, N-hexadecylmethylamine, N-stearylmethylamine, N-oleylmethylamine, N-dococylmethylamine, N-beef tallow alkyl methylamine, N-hardened beef tallow alkyl methylamine, N-soybean oil alkyl methylamine, ditetradecylamine, dipentadecylaimne, dihexadecylamine, distearylamine, dioleylamine, didococylamine, bis(2-hexyldecyl)amine, bis(2-octyldodecyl)amine, bis(2-decyltetradecyl)-amine, beef tallow dialkylamine, hardened beef tallow dialkylamine, and soybean oil dialkylamine; and trialk(en)ylamines such as tetradecyldimethylamine, hexadecyldimethylamine, octadecyldimethylamine, beef tallow alkyldimethylamine, hardened beef tallow alkyldimethylamine, soybean oil alkyldimethylamine, dioleylmethylamine, tritetradecylamine, tristearylamine, and trioleylamine. Secondary amines having two alkyl (or alkenyl) groups with 14 to 18 carbon atoms are often used.

Examples of the compound containing the hexavalent molybdenum atom include molybdenum trioxides or hydrates thereof ($MoO_3.nH_2O$), molybdenum acid ($H_2MoO_4$), alkali metal molybdates ($M_2MoO_4$) wherein M represents an alkali metal such as sodium and potassium, ammonium molybdates {$(NH_4)_2MoO_4$ or heptamolybdate $(NH_4)_6[Mo_7O_{24}].4H_2O$}, $MoOCl_4$, $MoO_2Cl_2$, $MoO_2Br_2$, $Mo_2O_3Cl_6$ and the like. Molybdenum trioxides or hydrates thereof, molybdenum acid, alkali metal molybdates and ammonium molybdates may be used because of their availability. In one embodiment, the lubricating composition comprises molybdenum amine compound.

Other organomolybdenum compounds of the invention may comprise the reaction products of fatty oils, monoalkylated alkylene diamines and a molybdenum source. Materials of this sort are generally made in two steps, a first step involving the preparation of an aminoamide/glyceride mixture at high temperature, and a second step involving incorporation of the molybdenum.

Examples of fatty oils that may be used include cottonseed oil, groundnut oil, coconut oil, linseed oil, palm kernel oil, olive oil, corn oil, palm oil, castor oil, rapeseed oil (low or high erucic acids), soyabean oil, sunflower oil, herring oil, sardine oil, and tallow. These fatty oils are generally known as glyceryl esters of fatty acids, triacylglycerols or triglycerides.

Examples of some mono-alkylated alkylene diamines that may be used include methylaminopropylamine, methylaminoethylamine, butylaminopropylamine, butylaminoethylamine, octylaminopropylamine, octylaminoethylamine, dodecylaaminopropylaamine, dodecylaminoethylamine, hexadecylaminopropylamine, hexadecylaminoethylamine, octadecylaminopropylamine, octadecylaminoethylamine, isopropyloxypropyl-1,3-diaminopropane, and octyloxypropyl-1,3-diaminopropane. Mono-alkylated alkylene diamines derived from fatty acids may also be used. Examples include N-coco alkyl-1,3-propanediamine (Duomeen®C), N-tall oil alkyl-1,3-propanediamine (Duomeen®T) and N-oleyl-1,3-propanediamine (Duomeen®O), all commercially available from Akzo Nobel.

Sources of molybdenum for incorporation into the fatty oil/diamine complex are generally oxygen-containing molybdenum compounds include, similar to those above, ammonium molybdates, sodium molybdate, molybdenum oxides and mixtures thereof. A suitablemolybdenum source comprises molybdenum trioxide ($MoO_3$).

Nitrogen-containing molybdenum compounds of the invention are commercially available, for example Sakuralube® 710 available from Adeka which is a molybdenum amine compound, and Molyvan® 855 available from R.T. Vandebilt.

The nitrogen-containing molybdenum compound may be present in the lubricant composition at 0.005 to 2 weight percent of the composition, or 0.01 to 1.3 weight percent of the composition, or even 0.02 to 1.0 weight percent of the composition. The molybdenum compound may provide the lubricant composition with 0 to 1000 ppm, or 5 to 1000 ppm, or 10 to 750 ppm 5 ppm to 300 ppm, or 20 ppm to 250 ppm of molybdenum.

Oil of Lubricating Viscosity

The lubricating composition comprises an oil of lubricating viscosity. Such oils include natural and synthetic oils, oil derived from hydrocracking, hydrogenation, and hydrofinishing, unrefined, refined and re-refined oils and mixtures thereof.

Unrefined oils are those obtained directly from a natural or synthetic source generally without (or with little) further purification treatment. Refined oils are similar to the unrefined oils except they have been further treated in one or more purification steps to improve one or more properties. Purification techniques are known in the art and include solvent extraction, secondary distillation, acid or base extraction, filtration, percolation and the like. Re-refined oils are also known as reclaimed or reprocessed oils, and are obtained by processes similar to those used to obtain refined oils and often are additionally processed by techniques directed to removal of spent additives and oil breakdown products.

Natural oils useful in making the inventive lubricants include animal oils, vegetable oils (e.g., castor oil,), mineral lubricating oils such as liquid petroleum oils and solvent-treated or acid-treated mineral lubricating oils of the paraffinic, naphthenic or mixed paraffinic-naphthenic types and oils derived from coal or shale or mixtures thereof.

Synthetic lubricating oils are useful and include hydrocarbon oils such as polymerized and interpolymerized olefins (e.g., polybutylenes, polypropylenes, propylene-isobutylene copolymers); poly(1-hexenes), poly(1-octenes), poly (1-decenes), and mixtures thereof; alkylbenzenes (e.g. dodecylbenzenes, tetradecylbenzenes, dinonyl¬ benzenes, di-(2-ethylhexyl)-benzenes); polyphenyls (e.g., biphenyls, terphenyls, alkylated polyphenyls); diphenyl alkanes, alkylated diphenyl alkanes, alkylated diphenyl ethers and alkylated diphenyl sulfides and the derivatives, analogs and homologs thereof or mixtures thereof.

Other synthetic lubricating oils include polyol esters (such as Priolube®3970), diesters, liquid esters of phosphorus-containing acids (e.g., tricresyl phosphate, trioctyl phosphate, and the diethyl ester of decane phosphonic acid), or polymeric tetrahydrofurans. Synthetic oils may be produced by Fischer-Tropsch reactions and typically may be hydroisomerized Fischer-Tropsch hydrocarbons or waxes. In one embodiment oils may be prepared by a Fischer-Tropsch gas-to-liquid synthetic procedure as well as other gas-to-liquid oils.

Oils of lubricating viscosity may also be defined as specified in the American Petroleum Institute (API) Base Oil Interchangeability Guidelines. The five base oil groups are as follows: Group I (sulfur content >0.03 wt %, and/or <90 wt % saturates, viscosity index 80-120); Group II (sulfur content <0.03 wt %, and >90 wt % saturates, viscosity index 80-120); Group III (sulfur content <0.03 wt %, and >90 wt % saturates, viscosity index >120); Group IV (all polyalphaolefins (PAOs)); and Group V (all others not included in Groups I, II, III, or IV). The oil of lubricating viscosity may also be an API Group II+ base oil, which term refers to a Group II base oil having a viscosity index greater than or equal to 110 and less than 120, as described in SAE publication "Design Practice: Passenger Car Automatic Transmissions", fourth Edition, AE-29, 2012, page 12-9, as well as in U.S. Pat. No. 8,216,448, column 1 line 57.

The oil of lubricating viscosity may be an API Group IV oil, or mixtures thereof, i.e., a polyalphaolefin. The polyalphaolefin may be prepared by metallocene catalyzed processes or from a non-metallocene process.

The oil of lubricating viscosity comprises an API Group I, Group II, Group III, Group IV, Group V oil or mixtures thereof. Often the oil of lubricating viscosity is an API Group I, Group II, Group II+, Group III, Group IV oil or mixtures thereof. Alternatively the oil of lubricating viscosity is often an API Group II, Group II+, Group III or Group IV oil or mixtures thereof. Alternatively the oil of lubricating viscosity is often an API Group II, Group II+, Group III oil or mixtures thereof.

The amount of the oil of lubricating viscosity present is typically the balance remaining after subtracting from 100 wt % the sum of the amount of the additive as described herein above, and the other performance additives.

The lubricating composition may be in the form of a concentrate and/or a fully formulated lubricant. If the lubricating composition of the invention is in the form of a concentrate (which may be combined with additional oil to form, in whole or in part, a finished lubricant), the ratio of the of components of the invention to the oil of lubricating viscosity and/or to diluent oil include the ranges of 1:99 to 99:1 by weight, or 80:20 to 10:90 by weight.

In certain embodiments, the lubricating composition may contain synthetic ester base fluids. Synthetic esters may have a kinematic viscosity measured at 100° C. of 2.5 $mm^2/s$ to 30 $mm^2/s$. In one embodiment, the lubricating composition comprises less than 50 weight percent of a synthetic ester base fluid with a kinematic viscosity at 100° C. of at least 5.5 $mm^2/s$, or at least 6 $mm^2/s$, or at least 8 $mm^2/s$.

Synthetic esters of the present invention may comprise esters of a dicarboxylic acids (e.g., phthalic acid, succinic acid, alkyl succinic acids and alkenyl succinic acids, maleic acid, azelaic acid, suberic acid, sebacic acid, fumaric acid, adipic acid, linoleic acid dimer, malonic acid, alkyl malonic acids, and alkenyl malonic acids) with any of variety of alcohols (e.g., butyl alcohol, hexyl alcohol, dodecyl alcohol, 2-ethylhexyl alcohol, ethylene glycol, diethylene glycol monoether, and propylene glycol). Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid.

Esters useful as synthetic oils also include those made from C5 to C12 monocarboxylic acids and polyols and polyol ethers such as neopentyl glycol, trimethylolpropane, pentaerythritol, dipentaerythritol, and tripentaerythritol. Esters can also be monoesters, such as are available under the trade name Priolube 1976™ (C18-alkyl-COO—C20 alkyl).

Synthetic ester base oils may be present in the lubricating composition of the invention in an amount less than 50 weight percent of the composition, or less than 40 weight %, or less than 35 weight %, or less than 28 weight %, or less than 21 weight %, or less than 17 weight %, or less than 10 weight %, or less than 5 weight % of the composition. In one embodiment, the lubricating composition of the invention is free of, or substantially free of, a synthetic ester base fluid having a kinematic viscosity of at least 5.5 $mm^2/s$ at 100° C.

The lubricating composition may be in the form of a concentrate and/or a fully formulated lubricant. If the lubricating composition of the disclosed technology (comprising the additives disclosed herein) is in the form of a concentrate which may be combined with additional oil to form, in whole or in part, a finished lubricant), the ratio of the of these additives to the oil of lubricating viscosity and/or to diluent oil include the ranges of 1:99 to 99:1 by weight, or 80:20 to 10:90 by weight. Typically the lubricating composition of the disclosed technology comprises at least 50 weight %, or at least 60 weight %, or at least 70 weight %, or at least 80 weight % of an oil of lubricating viscosity.

Other Performance Additives

A lubricating composition may be prepared by adding the product of the process described herein to an oil of lubricating viscosity, optionally in the presence of other performance additives (as described herein below).

The lubricating composition of the disclosed technology optionally comprises other performance additives. The other performance additives may include at least one of metal deactivators, viscosity modifiers, detergents, friction modifiers, antiwear agents, corrosion inhibitors, dispersants, extreme pressure agents, antioxidants, foam inhibitors, demulsifiers, pour point depressants, seal swelling agents (different from those of the invention) and mixtures thereof. Typically, fully-formulated lubricating oil will contain one or more of these performance additives.

In one embodiment the invention provides a lubricating composition further comprising an overbased metal-containing detergent. The metal of the metal-containing detergent may be zinc, sodium, calcium, barium, or magnesium. Typically the metal of the metal-containing detergent may be sodium, calcium, or magnesium.

The overbased metal-containing detergent may be chosen from sulfonates, non-sulfur containing phenates, sulfur containing phenates, salixarates, salicylates, and mixtures thereof, or borated equivalents thereof. The overbased detergent may be borated with a borating agent such as boric acid.

The overbased metal-containing detergent may also include "hybrid" detergents formed with mixed surfactant systems including phenate and/or sulfonate components, e.g. phenate/salicylates, sulfonate/phenates, sulfonate/salicylates, sulfonates/phenates/salicylates, as described; for example, in U.S. Pat. Nos. 6,429,178; 6,429,179; 6,153,565; and 6,281,179. Where, for example, a "hybrid sulfonate/phenate detergent" is employed, the "hybrid detergent" would be considered equivalent to amounts of distinct phenate and sulfonate detergents introducing like amounts of phenate and sulfonate soaps, respectively.

Typically, an overbased metal-containing detergent may be a zinc, sodium, calcium or magnesium salt of a sulfonate, a phenate, sulfur containing phenate, salixarate or salicylate. Overbased sulfonates, salixarates, phenates and salicylates typically have a total base number of 120 to 700 TBN.

Typically, the overbased metal-containing detergent may be a calcium or magnesium an overbased detergent.

In another embodiment the lubricating composition comprises a calcium sulfonate overbased detergent having a TBN of 120 to 700. The overbased sulfonate detergent may have a metal ratio of 12 to less than 20, or 12 to 18, or 20 to 30, or 22 to 25.

Overbased sulfonates typically have a total base number of 120 to 700, or 250 to 600, or 300 to 500 (on an oil free basis). Overbased detergents are known in the art. The sulfonate detergent may be a linear or branched alkylbenzene sulfonate detergent having a metal ratio of at least 8 as is described in paragraphs [0026] to [0037] of US Patent Application 2005065045 (and granted as U.S. Pat. No. 7,407,919). Linear alkyl benzenes may have the benzene ring attached anywhere on the linear chain, usually at the 2, 3, or 4 position, or mixtures thereof. Linear alkylbenzene sulfonate detergent may be particularly useful for assisting in improving fuel economy. In one embodiment, the alkylbenzene sulfonate detergent may be a branched alkylbenzene sulfonate, a linear alkylbenzene sulfonate, or mixtures thereof. In one embodiment, the lubricating composition may be free of linear alkylbenzene sulfonate detergent. In one embodiment the sulfonate detergent may be a metal salt of one or more oil-soluble alkyl toluene sulfonate compounds as disclosed in paragraphs [0046] to [0053] of US Patent Application 2008/0119378. The detergent, such as a branched alkylbenzenesulfonate detergent, may be present in the lubricating composition at 0.1 to 3 weight percent, or 0.25 to 1.5 weight percent, or even 0.5 to 1.1 weight percent.

In one embodiment the lubricating composition further comprises a "hybrid" detergent formed with mixed surfactant systems including phenate and/or sulfonate components, e.g. phenate/salicylates, sulfonate/phenates, sulfonate/salicylates, or sulfonates/phenates/salicylates.

The lubricating composition in a further embodiment comprises an antioxidant, wherein the antioxidant comprises a phenolic or an aminic antioxidant or mixtures thereof. The antioxidants include diarylamines, alkylated diarylamines, hindered phenols, or mixtures thereof. When present, the antioxidant may be present at 0.1 wt % to 3 wt %, or 0.5 wt % to 2.75 wt %, or 1 wt % to 2.5 wt % of the lubricating composition.

The diarylamine or alkylated diarylamine may be a phenyl-α-naphthylamine (PANA), an alkylated diphenylamine, or an alkylated phenylnapthylamine, or mixtures thereof. The alkylated diphenylamine may include di-nonylated diphenylamine, nonyl diphenylamine, octyl diphenylamine, di-octylated diphenylamine, di-decylated diphenylamine, decyl diphenylamine and mixtures thereof. In one embodiment the diphenylamine may include nonyl diphenylamine, dinonyl diphenylamine, octyl diphenylamine, dioctyl diphenylamine, or mixtures thereof. In another embodiment the alkylated diphenylamine may include nonyl diphenylamine, or dinonyl diphenylamine. The alkylated diarylamine may include octyl, di-octyl, nonyl, di-nonyl, decyl or di-decyl phenylnapthylamines.

The hindered phenol antioxidant often contains a secondary butyl and/or a tertiary butyl group as a sterically hindering group. The phenol group may be further substituted with a hydrocarbyl group (typically linear or branched alkyl) and/or a bridging group linking to a second aromatic group. Examples of suitable hindered phenol antioxidants include 2,6-di-tert-butylphenol, 4-methyl-2,6-di-tert-butylphenol, 4-ethyl-2,6-di-tert-butylphenol, 4 propyl-2,6-di-tert-butyhphenol or 4-butyl-2,6-di-tert-butylphenol, or 4-dodecyl-2,6-di-tert-butyhphenol. In one embodiment the hindered phenol antioxidant may be an ester and may include, e.g., Irganox™ L-135 from Ciba. A more detailed description of suitable ester-containing hindered phenol antioxidant chemistry is found in U.S. Pat. No. 6,559,105.

The lubricating composition may in a further embodiment include a dispersant, or mixtures thereof. While a boron-containing dispersant may be an enumerated component of certain embodiments of the disclosed technology, additional, non-borated dispersants may also be present. The dispersant may be a succinimide dispersant, a Mannich dispersant, a succinamide dispersant, a polyolefin succinic acid ester, amide, or ester-amide, or mixtures thereof. In one embodiment the dispersant may be present as a single dispersant. In one embodiment the dispersant may be present as a mixture of two or three different dispersants, wherein at least one may be a succinimide dispersant.

The succinimide dispersant may be derived from an aliphatic polyamine, or mixtures thereof. The aliphatic polyamine may be aliphatic polyamine such as an ethylenepolyamine, a propylenepolyamine, a butylenepolyamine, or mixtures thereof. In one embodiment the aliphatic polyamine may be ethylenepolyamine. In one embodiment the aliphatic polyamine may be chosen from ethylenediamine, diethylenetriamine, triethylenetetramine, tetraethylenepentamine, pentaethylene-hexamine, polyamine still bottoms, and mixtures thereof.

In one embodiment the dispersant may be a polyolefin succinic acid ester, amide, or ester-amide. For instance, a polyolefin succinic acid ester may be a polyisobutylene succinic acid ester of pentaerythritol, or mixtures thereof. A polyolefin succinic acid ester-amide may be a polyisobutylene succinic acid reacted with an alcohol (such as pentaerythritol) and a polyamine as described above.

The dispersant may be an N-substituted long chain alkenyl succinimide. An example of an N-substituted long chain alkenyl succinimide is polyisobutylene succinimide. Typically the polyisobutylene from which polyisobutylene succinic anhydride is derived has a number average molecular weight of 350 to 5000, or 550 to 3000 or 750 to 2500. Succinimide dispersants and their preparation are disclosed, for instance in U.S. Pat. Nos. 3,172,892, 3,219,666, 3,316,177, 3,340,281, 3,351,552, 3,381,022, 3,433,744, 3,444,170, 3,467,668, 3,501,405, 3,542,680, 3,576,743, 3,632,511, 4,234,435, Re 26,433, and U.S. Pat. Nos. 6,165,235, 7,238,650 and EP Patent Application 0 355 895 A.

The dispersants may also be post-treated by conventional methods by a reaction with any of a variety of agents. Among these are boron compounds (such as boric acid), urea, thiourea, dimercaptothiadiazoles, carbon disulfide, aldehydes, ketones, carboxylic acids such as terephthalic acid, hydrocarbon-substituted succinic anhydrides, maleic anhydride, nitriles, epoxides, and phosphorus compounds. In one embodiment the post-treated dispersant is borated. In one embodiment the post-treated dispersant is reacted with dimercaptothiadiazoles. In one embodiment the post-treated dispersant is reacted with phosphoric or phosphorous acid. In one embodiment the post-treated dispersant is reacted with terephthalic acid and boric acid (as described in US Patent Application US2009/0054278.

When present, the borated dispersant may be present at 0.01 wt % to 20 wt %, or 0.1 wt % to 15 wt %, or 0.1 wt % to 10 wt %, or 1 wt % to 6 wt %, or 1 to 3 wt % of the lubricating composition. Any non-borated dispersant may optionally be present in any of the amounts recited for the borated dispersant, or may be absent.

The succinimide dispersant may comprise a polyisobutylene succinimide, wherein the polyisobutylene from which polyisobutylene succinimide is derived has a number average molecular weight of 350 to 5000, or 750 to 2500.

Another class of additives that may perform as antiwear agents as well as in other roles includes oil-soluble titanium compounds as disclosed in U.S. Pat. No. 7,727,943 and US2006/0014651. The oil-soluble titanium compounds may function as antiwear agents, friction modifiers, antioxidants, deposit control additives, or more than one of these functions. In one embodiment the oil soluble titanium compound is a titanium (IV) alkoxide. The titanium alkoxide is formed from a monohydric alcohol, a polyol or mixtures thereof. The monohydric alkoxides may have 2 to 16, or 3 to 10 carbon atoms. In one embodiment, the titanium alkoxide is titanium (IV) isopropoxide. In one embodiment, the titanium alkoxide is titanium (IV) 2 ethylhexoxide. In one embodiment, the titanium compound comprises the alkoxide of a vicinal 1,2-diol or polyol. In one embodiment, the 1,2-vicinal diol comprises a fatty acid mono-ester of glycerol, often the fatty acid is oleic acid.

In one embodiment, the oil soluble titanium compound is a titanium carboxylate. In a further embodiment the titanium (IV) carboxylate is titanium neodecanoate.

The lubricating composition may in one embodiment further include a phosphorus-containing antiwear agent. Typically the phosphorus-containing antiwear agent may be a zinc dialkyldithiophosphate, phosphite, phosphate, phosphonate, and ammonium phosphate salts, or mixtures thereof. Zinc dialkyldithiophosphates are known in the art. The antiwear agent, of whatever type, may be present at 0 wt % to 3 wt %, or 0.1 wt % to 1.5 wt %, or 0.5 wt % to 0.9 wt % of the lubricating composition.

Extreme Pressure (EP) agents may also be present. EP agents that are soluble in the oil include sulfur- and chlorosulfur-containing EP agents, dimercaptothiadiazole or $CS_2$ derivatives of dispersants (typically succinimide dispersants), derivative of chlorinated hydrocarbon EP agents and phosphorus EP agents. Examples of such EP agents include chlorinated wax; sulfurized olefins (such as sulfurized isobutylene), a hydrocarbyl-substituted 2,5-dimercapto-1,3,4-thiadiazole, or oligomers thereof, organic sulfides and polysulfides such as dibenzyldisulfide, bis-(chlorobenzyl) disulfide, dibutyl tetrasulfide, sulfurized methyl ester of oleic acid, sulfurized alkylphenol, sulfurized dipentene, sulfurized terpene, and sulfurized Diels-Alder adducts; phosphosulfurized hydrocarbons such as the reaction product of phosphorus sulfide with turpentine or methyl oleate; phosphorus esters such as the dihydrocarbon and trihydrocarbon phosphites, e.g., dibutyl phosphite, diheptyl phosphite, dicyclohexyl phosphite, pentylphenyl phosphite; dipentylphenyl phosphite, tridecyl phosphite, distearyl phosphite and polypropylene substituted phenol phosphite; metal thiocarbamates such as zinc dioctyldithiocarbamate and barium heptylphenol diacid; amine salts of alkyl and dialkylphosphoric acids or derivatives including, for example, the amine salt of a reaction product of a dialkyldithio-phosphoric acid with propylene oxide and subsequently followed by a further reaction with $P_2O_5$; and mixtures thereof (as described in U.S. Pat. No. 3,197,405). The amount of EP agent, if present, may be 0.001 to 5 percent by weight, or 0.1 to 2 percent, or 0.2 to 1 percent by weight.

Foam inhibitors that may be useful in the lubricant compositions of the disclosed technology include polysiloxanes, copolymers of ethyl acrylate and 2-ethylhexylacrylate and optionally vinyl acetate; demulsifiers including fluorinated polysiloxanes, trialkyl phosphates, polyethylene glycols, polyethylene oxides, polypropylene oxides and (ethylene oxide-propylene oxide) polymers. The amount of foam inhibitor, if present, may be 0.001 to 0.012 percent by weight or to 0.004 percent, or 0.001 to 0.003 percent by weight.

Viscosity improvers (also sometimes referred to as viscosity index improvers or viscosity modifiers) may be included in the compositions of this invention. Viscosity improvers are usually polymers, including polyisobutenes, polymethacrylates (PMA) and polymethacrylic acid esters, diene polymers, polyalkylstyrenes, esterified styrene-maleic anhydride copolymers, hydrogenated alkenylarene-conjugated diene copolymers and polyolefins also referred to as olefin copolymer or OCP). PMA's are prepared from mixtures of methacrylate monomers having different alkyl groups. The alkyl groups may be either straight chain or branched chain groups containing from 1 to 18 carbon atoms. Most PMA's are viscosity modifiers as well as pour point depressants. In certain embodiments, the viscosity index improver is a polyolefin comprising ethylene and one or more higher olefin, such as propylene. Polymeric viscosity modifiers may be present in a lubricating composition from 0.1 to 10 weight percent, 0.3 to 5 weight percent, or 0.5 to 2.5 weight percent.

Pour point depressants that may be useful in the lubricant compositions of the disclosed technology include polyalphaolefins, esters of maleic anhydride-styrene copolymers, poly(meth)acrylates, polyacrylates or polyacrylamides.

Demulsifiers include trialkyl phosphates, and various polymers and copolymers of ethylene glycol, ethylene oxide, propylene oxide, or mixtures thereof.

Metal deactivators include derivatives of benzotriazoles (typically tolyltriazole), 1,2,4-triazoles, benzimidazoles, 2-alkyldithiobenzimidazoles or 2-alkyldithiobenzothiazoles. The metal deactivators may also be described as corrosion inhibitors.

Seal swell agents include sulfolene derivatives Exxon Necton-37™ (FN 1380) and Exxon Mineral Seal Oil™ (FN 3200).

An engine lubricant composition in different embodiments may have a composition as disclosed in the following table:

| | Embodiments (wt %) | | |
|---|---|---|---|
| Additive | A | B | C |
| Antimony Dithiocarbamate | 0.025 to 4 | 0.05 to 1.8 | 0.1 to 0.8 |
| Ash-free Friction Modifier | 0.01 to 6 | 0.05 to 4 | 0.1 to 2 |
| Molybdenum Compound | 0 or 0.001 to 2 | 0.005 to 1.2 | 0.01 to 0.6 |
| (Borated) Dispersant | 0 to 12 | 0.5 to 8 | 1 to 6 |
| Overbased Detergent | 0 to 9 | 0.5 to 8 | 1 to 5 |
| Corrosion Inhibitor | 0 or 0.05 to 2 | 0.1 to 1 | 0.2 to 0.5 |
| Dispersant Viscosity Modifier | 0 to 5 | 0 to 4 | 0.05 to 2 |
| Antioxidant | 0 or 0.1 to 13 | 0.1 to 10 | 0.5 to 5 |
| Antiwear Agent | 0 or 0.1 to 15 | 0.1 to 10 | 0.3 to 5 |
| Viscosity Modifier | 0 to 10 | 0.5 to 8 | 1 to 6 |
| Any Other Performance Additive | 0 to 10 | 0 to 8 | 0 to 6 |
| Syn-Ester Base Fluid | 0 to 50 | 0 to 35 | 1 to 25 |
| Oil of Lubricating Viscosity | 10 to 99% or 20 to 95%, typically Balance to 100% | | |

Industrial Application

The technology disclosed may include a method of lubricating an internal combustion engine for a motorcycle equipped with a wet clutch, comprising supplying to the engine a lubricating composition comprising (a) an oil of lubricating viscosity, (b) an antimony dialkyldithiocarbamate compound, and (c) an ash-free friction modifier, wherein the lubricating composition comprises less than 50 weight percent of a synthetic ester having a kinematic viscosity of 5.5 to 25 $mm^2/s$ when measured at 100° C.

The technology disclosed may include a method of lubricating an internal combustion engine for a motorcycle equipped with a wet clutch, comprising supplying to the engine a lubricating composition comprising (a) an oil of lubricating viscosity, (b) an antimony dialkyldithiocarbamate compound, (c) an ash-free friction modifier, and (d) a nitrogen-containing molybdenum compound where said molybdenum compound does not contain dithiocarbamate, wherein the lubricating composition comprises less than 50 weight percent of a synthetic ester having a kinematic viscosity of 5.5 to 25 $mm^2/s$ when measured at 100° C.

The technology disclosed may include a method of lubricating an internal combustion engine comprising supplying to the engine a lubricating composition comprising (a) an oil of lubricating viscosity, (b) 0.0025 to 2.5 wt % of an antimony dialkyldithiocarbamate compound, (c) 0.05 to 2 wt % of an ash-free friction modifier, and (d) 0.1 to 3 wt % of a borated dispersant wherein the lubricating composition comprises less than 50 weight percent of a synthetic ester having a kinematic viscosity of 5.5 to 25 $mm^2/s$ when measured at 100° C.

The technology disclosed may include a method of lubricating an internal combustion engine comprising supplying to the engine a lubricating composition comprising (a) an oil of lubricating viscosity, (b) 0.0025 to 2.5 wt % of an antimony dialkyldithiocarbamate compound, (c) 0.05 to 2 wt % of an ash-free friction modifier, (d) 0.1 to 3 wt % of a borated dispersant, and (e) 0.1 to 3 wt % of an overbased alkylbenzene sulfonate detergent comprising at least 50 weight percent branched alkylgroups, wherein the lubricating composition comprises less than 50 weight percent of a synthetic ester having a kinematic viscosity of 5.5 to 25 $mm^2/s$ when measured at 100° C. The technology disclosed may include a method of improving fuel economy in a motorcycle engine equipped with a wet clutch comprising supplying to the engine a lubricating composition comprising (a) an oil of lubricating viscosity, (b) an antimony dialkyldithiocarbamate compound, and (c) an ash-free friction modifier, wherein the lubricating composition comprises less than 50 weight percent of a synthetic ester having a kinematic viscosity of 5.5 to 25 $mm^2/s$ when measured at 100° C.

The internal combustion engine may be a 4-stroke engine. The internal combustion engine may be fitted with an emission control system or a turbocharger. Examples of the emission control system include diesel particulate filters (DPF), or systems employing selective catalytic reduction (SCR).

The internal combustion engine may be port fuel injected or direct injection. In one embodiment, the internal combustion engine is a gasoline direct injection (GDI) engine.

The lubricating composition may have a total sulfated ash content of 1.2 wt % or less. The sulfur content of the lubricating composition may be 1 wt % or less, or 0.8 wt % or less, or 0.5 wt % or less, or 0.3 wt % or less. In one embodiment the sulfur content may be in the range of 0.001 wt % to 0.5 wt %, or 0.01 wt % to 0.3 wt %. The phosphorus content may be 0.2 wt % or less, or 0.12 wt % or less, or 0.1 wt % or less, or 0.085 wt % or less, or 0.08 wt % or less, or even 0.06 wt % or less, 0.055 wt % or less, or 0.05 wt % or less. In one embodiment the phosphorus content may be 0.04 wt % to 0.12 wt %. In one embodiment the phosphorus content may be 100 ppm to 1000 ppm, or 200 ppm to 600 ppm. The total sulfated ash content may be 0.3 wt % to 1.2 wt %, or 0.5 wt % to 1.1 wt % of the lubricating composition. In one embodiment the sulfated ash content may be 0.5 wt % to 1.1 wt % of the lubricating composition.

In one embodiment the lubricating composition may be characterized as having (i) a sulfur content of 0.5 wt % or less, (ii) a phosphorus content of 0.15 wt % or less, and (iii) a sulfated ash content of 0.5 wt % to 1.5 wt % or less.

The lubricating composition may be characterized as having at least one of (i) a sulfur content of 0.2 wt % to 0.4 wt % or less, (ii) a phosphorus content of 0.08 wt % to 0.15 wt %, and (iii) a sulfated ash content of 0.5 wt % to 1.5 wt % or less.

The lubricating composition may be characterized as having a sulfated ash content of 0.5 wt % to 1.2 wt %.

As used herein TBN values are (total base number) measured by the methodology described in D4739 (buffer).

The lubricating composition may be characterized as having a total base number (TBN) content of at least 5 mg KOH/g. The lubricating composition may be characterized as having a total base number (TBN) content of 6 to 13 mg KOH/g, or 7 to 12 mg KOH/g. The lubricant may have a SAE viscosity grade of XW-Y, wherein X may be 0, 5, 10, or 15; and Y may be 16, 20, 30, 40, or 50 or a monograde viscosity of SAE 20, 30, 40, or SAE 50.

The internal combustion engine disclosed herein may have a steel surface on a cylinder bore, cylinder block, or piston ring.

The internal combustion engine may have a surface of steel, or an aluminum alloy, or an aluminum composite. The internal combustion engine may be an aluminum block engine where the internal surface of the cylinder bores has been thermally coated with iron, such as by a plasma transferred wire arc (PTWA) thermal spraying process. Thermally coated iron surfaces may be subjected to conditioning to provide ultra-fine surfaces.

EXAMPLES

The following examples provide illustrations of the invention. These examples are non-exhaustive and are not intended to limit the scope of the invention.

A series of 5W-30 motorcycle lubricants are prepared as summarized in Table 1. The inventive oil example of the invention (Oil 1) contains antimony dithiocarbamate, an ash-free friction modifier, a borated dispersant, and a branched alkylbenzene sulfonic acid detergent as well as several other conventional lubricant additives. The Inventive oil is evaluated and compared to a similarly formulated oil without the antimony compound (Comp Oil 1) as well as a commercially available high performance racing oil, Motul™ 300V (Comp Oil 2).

TABLE 1

| Lubricating Compositions | | | |
|---|---|---|---|
| | Oil 1 | Comp Oil 1 | Comp Oil 2[11] |
| PAO 4 (poly-α-olefin base oil) | 55.10 | 55.10 | Balance |
| Synthetic ester[2] | 25.00 | 25.00 | Present |
| Ash-free FM[3] | 0.15 | 0.15 | GMO |
| Antimony DTC[4] | 0.125 | 0 | 0 |
| Borated Succinimide Dispersant | 1.34 | 1.34 | 3 |
| Linear Ca Sulfonate[5] | 0.14 | 0.14 | 0.9 |
| Branched Ca Sulfonate[6] | 0.59 | 0.59 | — |
| Molybdenum amine[7] | 0.005 | 0.005 | 0.2 |
| Conventional Succinimide Dispersant | 2.5 | 2.5 | — |
| Ashless Antixodants[8] | 1.22 | 1.22 | 0.7 |
| Secondary ZDDP[12] | 1.0 | 1.0 | 0.95 |
| Calcium Phenate Detergent | 0.4 | 0.4 | — |
| Titanium Additive[14] | 0.06 | 0.06 | — |
| Other Additives[9] | 0.1 | 0.1 | NI |
| Viscosity Modifier[10] | 5.8 | 6.0 | NI |
| Process/Diluent Oil | Balance to 100% | | NI |
| | ELEMNTALS/ANALYTICALS | | |
| Kinematic Viscosity at 100° C., $mm^2/s$ | 11.06 | 11.07 | 11.17 |
| Viscosity Index | 169 | 170 | 172 |
| CCS[13] @−30, centipoise | 5500 | 5250 | 5150 |
| Antimony (weight %) | 0.017 | 0 | 0 |
| Boron (weight %) | 0.039 | 0.038 | 0.014 |
| Calcium (weight %) | 0.208 | 0.209 | 0.240 |
| Molybdenum (weight %) | 0.001 | 0.001 | 0.018 |

TABLE 1-continued

| Lubricating Compositions | | | |
|---|---|---|---|
| | Oil 1 | Comp Oil 1 | Comp Oil 2[11] |
| Phosphorus (weight %) | 0.096 | 0.097 | 0.089 |
| Sulfur (weight %) | 0.360 | 0.325 | 0.302 |
| Titanium (weight %) | 0.005 | 0.005 | 0 |
| ASTM D2986 TBN | 8.6 | 8.6 | 8.4 |

[1]All treat rates on an oil-free basis
[2]Trimethylol propane (TMP) tri-ester of isostearic acid, kinematic viscosity 14.4 $mm^2/s$ (100° C.)
[3]Oleyl tartrimide
[4]Di(2-ethylhexyl)dithiocarbamate
[5]Overbased calcium linear alkylbenzene sulfonate detergent (690 TBN)
[6]Overbased calcium branched alkylbenzenesulfonate detergent (TBN 600)
[7]Sakuralube ™ 710 from Adeka Corp.
[8]Mixture of alkylated diarylamine, sulfurized olefin and hindered phenol
[9]Other additives include pourpoint depressant and foam inhibitor
[10]Dispersant polymethacrylate (Mn = 20,000)
[11]Motul ™ 300V contains a synthetic ester of unknown composition, a borated dispersant, and a molybdenum additive of unknown composition
[12]Zinc dialkyldithiophosphate with secondary alkyl groups
[13]Cold crank simulator viscosity at −30° C., ASTM D 5293
[14]A titanium alkoxide
NI = no information
— = not observed The lubricants are evaluated for cleanliness, i.e. the ability to prevent or reduce deposit formation; wear resistance; oxidative stability; fuel economy (often measured as lower dynamic frictional performance); thermal stability; and balance of static and dynamic friction performance. Bench and engine test results are summarized in Table 2 below.

Deposit control is measured by the Komatsu Hot Tube (KHT) test as well as the MHT TEOST and TEOST 33C bench tests. The KHT test employs heated glass tubes through which sample lubricant is pumped, approximately 5 mL total sample, typically at 0.31 mL/hour for an extended period of time, such as 16 hours, with an air flow of 10 mL/minute. The glass tube is rated at the end of test for deposits on a scale of 0 (very heavy varnish) to 10 (no varnish). The MHT TEOST (ASTM D7097) and TEOST 33C test (ASTM D6335) are carried out according to standard test procedures.

Oxidative stability is evaluated with the CEC L-85-99 bench test; this is a pressure differential scanning calorimetry (PDSC) method which measures oxidation induction time (OIT). Wear protection is evaluated in the 4Ball test (ASTM 4172), which provides both a wear scar result as well as a coefficient of friction measurement.

Three performance/engine tests are also carried out. These tests measure thermal stability, using the Honda motor driven test and the Yamaha fired engine test; and the balance of dynamic and static friction with the JASO T903:2011 performance test.

In the Honda thermal stability test, an electric motor is used to drive a single cylinder, air-cooled, Honda engine having a nominal displacement of 110 $cm^3$. The tests are conducted by using the electric motor to power the un-fired motorcycle engine to an engine speed of 6000 RPM, measured at the engine's crankshaft. This condition is maintained at steady state for one (1) hour duration. The entire evaluation is conducted with the engine's transmission in fourth ($4^{th}$) gear. No external cooling sources are employed and the engine is allowed to reach equilibrium temperatures during each test. Lubricant performance is evaluated by comparing the maximum engine oil sump temperature and cylinder head temperature measured at the spark plug. Engine oils which result in lower oil sump temperatures and cylinder head (measured at spark plug) temperatures offer improved performance. This test has been developed for the development of this engine oil.

A fired-engine thermal stability test has also been developed for this project using a Yamaha engine having a nominal displacement of 125 $cm^3$. The Yamaha engine utilizes air-cooling and a single cylinder configuration. During this evaluation, the engine is operated in fifth ($5^{th}$) gear at an engine speed of 6400 RPM measured at the engine's crankshaft. The engine's throttle is controlled to maintain a load of 5.75 kW. A water cooled eddy current dynamometer is used to absorb engine load and maintain engine speed. Each test is conducted for 1 hour. During the test time, engine oil sump temperature and cylinder head temperature (measured at the spark plug) are monitored. Engine lubricant performance is evaluated by comparison of maximum values engine oil sump temperature and cylinder head (measured at spark plug) temperature. Again, lubricants which reduce temperatures offer improved performance.

The industry-standard JASO T 903:2011 test utilize a clutch pack consisting of several steel disks and fiber plates enclosed in a test head. The clutch pack operates in a temperature controlled oil bath. An electric motor is then used to rotate the fiber plates to 3,600 RPM while the steel disks are held static in the test head. During this motoring phase, there is no pressure applied to the clutch pack. Once speed and temperature set points are met, pressure is then applied to the clutch pack to cause lock up. This event is referred to as a dynamic engagement. A metal disc connected to the electric motor simulates vehicle inertia. During this dynamic engagement, parameters such as speed and torque are measured and are used to calculate the Dynamic Friction Characteristic Index (DFI) and Stop Time Index (STI). These are the first two parameters which are used to classify an engine oil's frictional performance. The third parameter is called the Static Friction Characteristic Index (SFI). For this evaluation, the same test rig is used, but now the evaluation begins with the pressure applied to the clutch to facilitate lock up. A low speed (300 RPM), high torque motor is used to 'break' the clutch pack loose and cause slippage. Once again, torque, speed, and other parameters are measured and used to calculate SFI.

TABLE 2

Bench and Engine Test Results

| | Oil 1 | Comp Oil 1 | Comp Oil 2 |
|---|---|---|---|
| L-85-99 OIT (min) | 230.2 | 213.2 | 222.4 |
| D4172 (4-BALL WEAR) | — | | — |
| Average Scar Diameter (mm) | 0.42 | 0.36 | 0.47 |
| Friction Coefficient | 0.093 | 0.106 | 0.108 |
| D6335 (TEOST 33C) | — | | — |
| Rod Deposits (mg) | 7.5 | 8.0 | 7.5 |
| Filter Deposits (mg) | 1.0 | 1.3 | 1.4 |
| Total Deposits (mg) | 8.5 | 9.3 | 8.9 |
| D7097 (MHT TEOST) | — | | — |
| Rod Deposits (mg) | 12.1 | 12.1 | 25.5 |
| Filter Deposits (mg) | 2.2 | 2.4 | 2.2 |
| Total Deposits (mg) | 14.3 | 14.5 | 27.7 |
| Komatsu Hot Tube (KHT) (280° C.) | — | | — |
| Tube Visual Rating | 8 | 8.5 | 8 |
| Honda Thermal Stability (motor-driven) | — | | — |
| Max Sump Temp (° C.) | 96.8 | 97.7 | 99.7 |
| Max Plug Temp (° C.) | 100.4 | 100.9 | 103.6 |
| Yamaha Thermal Stability (fired engine) | — | | — |

TABLE 2-continued

Bench and Engine Test Results

| | Oil 1 | Comp Oil 1 | Comp Oil 2 |
|---|---|---|---|
| Max Sump Temp (° C.) | 111.20 | 113.56 | 117.88 |
| Max Plug Temp (° C.) | 191.82 | 197.20 | 201.52 |
| JASO T903:2011 | — | | — |
| Dynamic FI (DFI) | 1.75 | | 2.07 |
| Static FI (SFI) | 1.69 | | 1.77 |
| Stop Time Index | 1.84 | | 2.02 |

As the results indicate, the inventive lubricant composition provides for improved thermal stability by both the Honda and Yamaha tests, reduction in dynamic friction without significant decrease in static friction, and improved wear and oxidative stability while maintaining or improving deposit/cleanliness performance.

It is known that some of the materials described above may interact in the final formulation, so that the components of the final formulation may be different from those that are initially added. The products formed thereby, including the products formed upon employing lubricant composition of the present invention in its intended use, may not be susceptible of easy description. Nevertheless, all such modifications and reaction products are included within the scope of the present invention; the present invention encompasses lubricant composition prepared by admixing the components described above.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil, which may be customarily present in the commercial material, unless otherwise indicated. It is to be understood that the upper and lower amount, range, and ratio limits set forth herein may be independently combined. Similarly, the ranges and amounts for each element of the invention may be used together with ranges or amounts for any of the other elements.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed:

1. A method of operating a 4-stroke motorcycle engine equipped with a wet clutch, wherein the crankcase and wet clutch are lubricated with the same lubricant composition, said method comprising supplying to the engine and clutch a lubricant composition comprising (a) an oil of lubricating viscosity, (b) about 0.025 to about 1.0 percent by weight of an antimony dialkyldithiocarbamate compound, and (c) about 0.05 to about 4 percent by weight of an ash-free friction modifier comprising at least one of long chain fatty acid derivatives of amines, long chain fatty esters, derivatives of long chain fatty epoxides, fatty imidazolines; amine salts of alkylphosphoric acids, or fatty esters, amides or imides of hydroxy-carboxylic acids, wherein the lubricating composition comprises less than 50 weight percent of a synthetic ester having a kinematic viscosity of 5.5 to 25 $mm^2/s$ when measured at 100° C.

2. The method of claim 1, wherein the lubricating composition further comprises (d) a nitrogen-containing molybdenum compound other than a dithiocarbamate complex.

3. The method of claim 2, wherein the nitrogen-containing molybdenum compound is a molybdenum amine complex.

4. The method of claim 1, wherein the ash-free friction modifier is an ester, amide, or imide of an alpha-hydroxy carboxylic acid.

5. The method of claim 1, wherein the ash-free the friction modifier is an ester, amide, or imide of tartaric acid, citric acid, malic acid, lactic acid, glycolic acid, oligomers of said acids, or combinations thereof.

6. The method of claim 1, wherein the ash-free friction modifier is an imide, ester, or amide of tartaric acid.

7. The method of claim 1, wherein the lubricant composition further comprises (e) 0.1 to 3 weight percent of a boron-containing dispersant.

8. The method of claim 1, wherein the lubricant composition further comprises (f) 0.1 to 3 weight percent of an alkylbenzenesulfonate detergent, wherein the alkyl groups comprise at least 50 weight percent branched alkyl groups.

9. The method of claim 1, wherein the lubricant composition comprises less than 40 weight % of a synthetic ester with a kinematic viscosity of at least 5.5 $mm^2/s$ at 100 ° C.

10. A motorcycle lubricant composition comprising (a) an oil of lubricating viscosity, (b) about 0.025 to about 1.0 percent by weight of an antimony dialkyldithiocarbamate compound, (c) about 0.05 to about 4 percent by weight of an ash-free friction modifier comprising at least one of long chain fatty acid derivatives of amines, long chain fatty esters, derivatives of long chain fatty epoxides, fatty imidazolines; amine salts of alkylphosphoric acids, or fatty esters, amides or imides of hydroxy-carboxylic acids, (d) a nitrogen-containing molybdenum compound other than a dithiocarbamate complex, (e) 0.1 to 3 weight percent of a boron-containing dispersant, and (f) 0.1 to 3 weight percent of an alkylbenzenesulfonate detergent, wherein the alkyl groups comprise at least 50 weight percent branched alkyl groups, wherein the lubricating composition comprises less than 50 weight percent of a synthetic ester having a kinematic viscosity of 5.5 to 25 $mm^2/s$ when measured at 100 ° C.

11. The method of claim 2 wherein the amount of the nitrogen-containing molybdenum compound other than a dithiocarbamate complex in the lubricant composition is about 0.005 to about 2 weight percent.

12. The composition of claim 10 wherein the amount of the nitrogen-containing molybdenum compound other than a dithiocarbamate complex is about 0.005 to about 2 weight percent.

* * * * *